US012270192B2

(12) United States Patent
Elitas

(10) Patent No.: US 12,270,192 B2
(45) **Date of Patent: *Apr. 8, 2025**

(54) SCENTED BIDET NOZZLE CONSTRUCT

(71) Applicant: Edip Ali Elitas, Fairview, NJ (US)

(72) Inventor: Edip Ali Elitas, Fairview, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/910,320

(22) Filed: Oct. 9, 2024

(65) Prior Publication Data

US 2025/0043557 A1 Feb. 6, 2025

Related U.S. Application Data

(63) Continuation of application No. 18/547,479, filed as application No. PCT/TR2023/050769 on Aug. 3, 2023.

(51) Int. Cl.
*E03D 9/00* (2006.01)
*E03D 9/08* (2006.01)

(52) U.S. Cl.
CPC ..... *E03D 9/005* (2013.01); *E03D 9/08* (2013.01)

(58) Field of Classification Search
CPC ..... E03D 9/005; E03D 9/08
USPC ..... 4/448, 420.4, 447, 443
See application file for complete search history.

(56) References Cited

U.S. PATENT DOCUMENTS

2005/0022295 A1* 2/2005 Jung ..... E03D 9/08 4/420.4
2005/0229301 A1* 10/2005 Hassan ..... A47K 13/302 4/420.4
2008/0060119 A1* 3/2008 Pinizzotto ..... E03D 9/005 4/217
2017/0058500 A1* 3/2017 Garrels ..... E03D 5/10
2020/0359857 A1* 11/2020 Loutos ..... E03D 9/08
2021/0388594 A1* 12/2021 Hall ..... A61B 8/085
2023/0046125 A1 2/2023 Maniaci
(Continued)

FOREIGN PATENT DOCUMENTS

CN 104420524 A 3/2015
CN 216973628 U 7/2022
DE 102020128363 A1 * 4/2022 ..... E03D 1/26
(Continued)

OTHER PUBLICATIONS

International Search Report for related PCT/TR2023/050769 dated Mar. 22, 2024.

*Primary Examiner* — Lori L Baker
(74) *Attorney, Agent, or Firm* — Egbert, McDaniel & Swartz, PLLC

(57) ABSTRACT

A bidet nozzle construct includes a bidet nozzle having a main body which is connected on the toilet under the toilet seat lid, a water sprayer which extends from below the main body into the toilet bowl to spray clean water from the rear part of the toilet bowl, a valve which is positioned next to the toilet bowl at one end of the main body and enables the water sprayer to be turned on and off, and a scent module including a module main body, which is disposed at the front end of the valve of the bidet nozzle. A scent tube is located inside the module main body and sprays, by a spray tip positioned inside the module main body, an essence via the scent release outlet of the module main body, as a result of a force being applied on the pressure surface under the scent tube.

8 Claims, 4 Drawing Sheets

(56) References Cited

U.S. PATENT DOCUMENTS

| | | | | | |
|---|---|---|---|---|---|
| 2023/0165994 | A1* | 6/2023 | Andersen | ..... | A61L 9/012<br>424/466 |

FOREIGN PATENT DOCUMENTS

| | | | | | |
|---|---|---|---|---|---|
| KR | 200343389 | Y1 | | 2/2004 | |
| KR | 20100055306 | A | | 5/2010 | |
| WO | WO-0222971 | A1 | * | 3/2002 | ..... E03D 1/26 |
| WO | WO-2011061478 | A1 | * | 5/2011 | ..... A01M 1/205 |
| WO | WO-2018203729 | A2 | * | 11/2018 | ..... A47K 13/24 |
| WO | WO-2020028571 | A2 | * | 2/2020 | ..... E03D 9/08 |
| WO | WO-2022149002 | A1 | * | 7/2022 | ..... E03D 1/26 |
| WO | WO-2022220358 | A1 | * | 10/2022 | ..... E03D 1/26 |
| WO | WO-2023218222 | A1 | * | 11/2023 | ..... E03D 1/26 |

* cited by examiner

SCENTED BIDET NOZZLE CONSTRUCT

CROSS-REFERENCE TO RELATED APPLICATIONS

The present application is a continuation of U.S. application Ser. No. 18/547,479, filed on Aug. 22, 2023, presently pending. U.S. application Ser. No. 18/547,479 is a § 371 National Stage of PCT/TR2023/050769, filed Aug. 3, 2023.

FIELD OF THE INVENTION

The invention relates to the bidet nozzles with modular structure, which are intended for external use in the toilets.

More particularly, the invention relates to a bidet nozzle construct, which enables the need of personal cleaning to be met in the toilets with no bidet nozzle and enables the ambience to be scented by means of a scent module.

BACKGROUND OF THE INVENTION

Today, the bidet nozzles that are adapted on the toilets are used in order to enable the personal cleaning once a user finishes using the toilet. However, there is no bidet nozzle in the toilets in the European countries and the external wash-bowl types referred to as bidet are used instead, in order to meet the personal cleaning need following the use of a toilet in the bathrooms or the toilet rooms.

The bidet nozzles, which are externally adapted on the toilets, have been developed according to the state of the art, in order to enable the users to wash themselves in the toilets that lack a bidet nozzle, instead of using a bidet. Said bidet nozzles have a nozzle, which is conventionally connected under the toilet seat lid and which sprays the clean water from the rear part of the toilet bowl by means of an on/off water valve positioned next to the toilet bowl, in order to enable the cleaning need to be satisfied. These bidet nozzles are intended only for enabling the need of personal cleaning to be satisfied and provide for this purpose the flow of clean water by being adapted on a toilet. However, the need has arisen to develop the external bidet nozzles in accordance with today's increased comfort demands and other needs.

The document no. KR20100055306A found in the literature search may be mentioned as an example of the state of the art. Said document relates to a bidet for a toilet seat lid. A bidet for a toilet, comprising a bidet body, a nozzle assembly and a drive device, is disclosed in said invention. Said bidet body is placed in a toilet bowl. The nozzle assembly is arranged inside the bidet body and has a nozzle with a reciprocating motion. The drive device is installed in one side of the nozzle assembly and reciprocates and rotates said nozzle assembly. According to the invention disclosed in said document, the adjustment of the position of washing is enabled by moving the nozzle assembly. However, a mechanism, which is disposed on said bidet and which enables the ambience to be scented, is not mentioned in this document.

The document no. CN104420524A may be mentioned as another example of the state of the art. Said document relates to a hygienic function device, which is able to swing to the left and the right. Said hygienic function device basically comprises a function pipe, a body and a pendulous device. Said pendulous device is used to drive the function pipe to carry out the leftward and rightward reciprocating rotation in the axial direction. The hygienic function device disclosed in said invention has the action of enabling the function pipe to be dried and/or washed in the left and right directions through the leftward and rightward circulation of said function pipe and further provides the actions of forward-backward tensioning and retraction. However, a mechanism, which is disposed on said hygienic function device and which enables the ambience to be scented, is not mentioned in this document.

Consequently, the presence of the above-mentioned problems and the inadequacy of the available solutions have made it necessary to carry out an improvement in the relevant art.

SUMMARY OF THE INVENTION

The present invention relates to a scented bidet nozzle construct, which eliminates the above-mentioned disadvantages and provides the relevant art with new advantages.

A primary object of the invention is to offer a bidet nozzle construct, which enables the need of personal cleaning to be met in the toilets with no bidet nozzle and enables the ambience to be scented by means of a scent module.

Another object of the invention is to offer a bidet nozzle construct, which enables the elimination of the resulting malodors after the use of the toilets and provides the user comfort.

Another object of the invention is to offer a bidet nozzle construct, which enables an external bidet nozzle to be used in a functional manner.

In order to achieve the above-mentioned objects and all the other objects possible to become evident from the detailed description, the invention is a bidet nozzle construct externally used in the toilets in order to meet the need of personal cleaning, said bidet nozzle construct comprising a bidet nozzle including a main body, which is connected on the toilet under the toilet seat lid, at least one water sprayer, which extends from below the main body into the toilet bowl to spray the clean water from the rear part of the toilet bowl to enable the cleaning, and a valve, which is positioned next to the toilet bowl at one end of the main body and enables the water sprayer to be turned on and off, wherein said bidet nozzle construct further comprises a scent module including:

- a module main body, which is disposed at the front end of the valve of the bidet nozzle and has a tube housing,
- a scent release outlet, which is disposed inside the tube housing,
- a scent tube, which is located on the horizontal axis inside the module main body and inside which an essence is stored, and
- a spray tip, which is located on the scent tube and sprays the essence inside the scent tube via the scent release outlet into the ambience as a result of a force being applied on the pressure surface under the scent tube.

The structural and characteristic features and all the advantages of the invention will be more clearly understood from the figures provided below and the detailed description written with reference to said figures. Accordingly, the evaluation should be made taking these figures and the detailed description into consideration.

DESCRIPTION OF THE REFERENCE SIGNS

Figure 1:
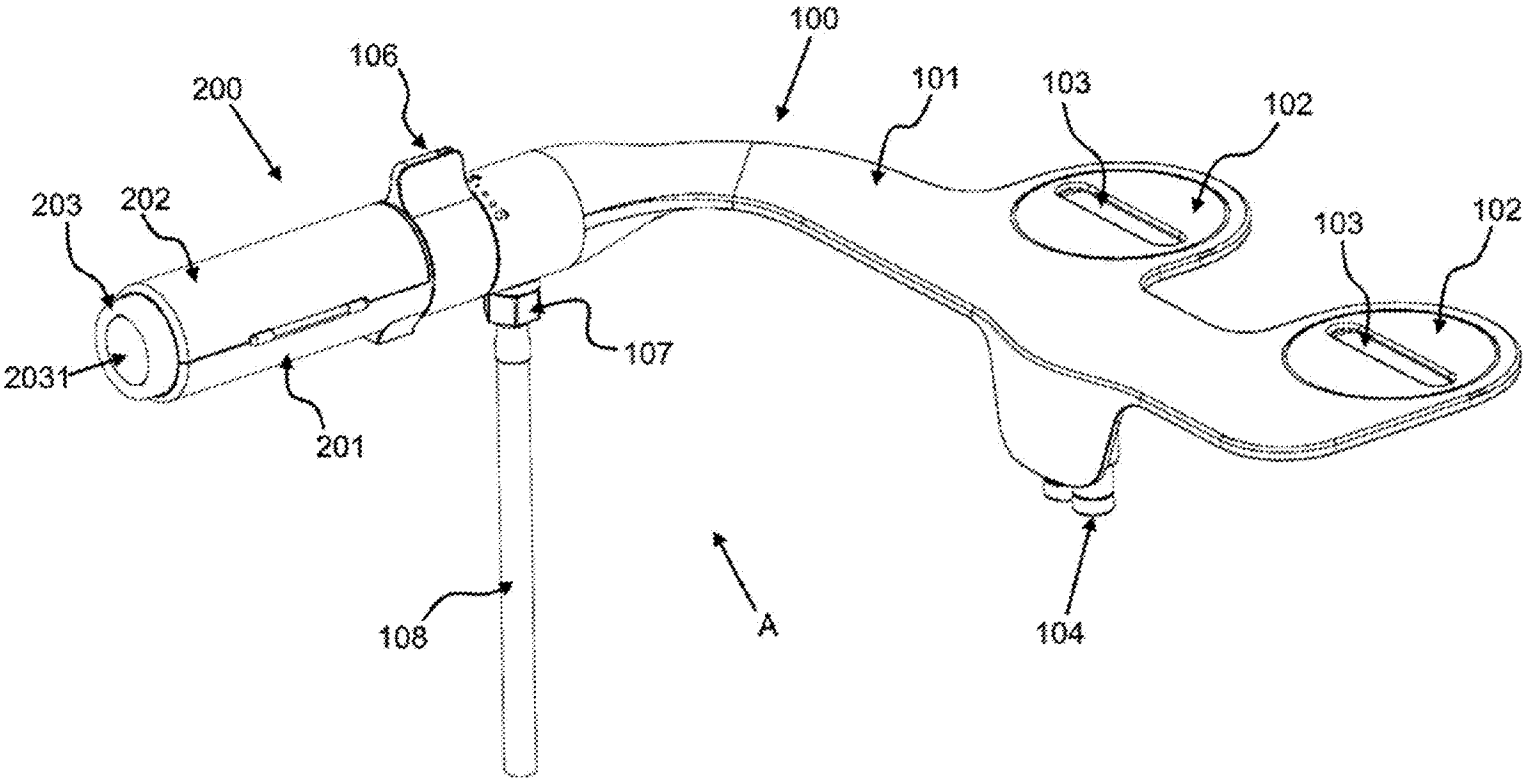
FIG. 1 is a perspective view of the bidet nozzle construct according to the invention.

A. Bidet nozzle construct
100. Bidet nozzle
101. Main body
102. Fixing port
103. Pod channel
104. Water sprayer
105. Barrier
106. Valve
1061. Cylindrical surface
107. Water inlet
108. Water inlet hose
200. Scent module
201. Module main body
2011. Tube housing
2012. Tube tip housing
2013. Scent release outlet
202. Cover
203. Scent tube
2031. Pressure surface
2032. Hose retainer
204. Spray tip
2041. Pressure head
2042. Scent hose
205. Retaining surface
Y. Horizontal assembly axis

DETAILED DESCRIPTION OF THE INVENTION

In this detailed description, the preferred alternatives of the bidet nozzle construct (A) according to the invention will be described only to enable a better understanding of the subject matter, without leading to any limiting effect.

FIG. 1 provides an overall view of the bidet nozzle construct (A) according to the invention. Accordingly, the bidet nozzle construct (A) comprises in its most basic form a bidet nozzle (100) including a main body (101), which is connected on the toilet under the toilet seat lid, at least one water sprayer (104), which extends from below the main body (101) into the toilet bowl to spray clean water from the rear part of the toilet bowl to enable the cleaning, and a valve (106), which is positioned next to the toilet bowl at one end of the main body (101) and enables the water sprayer (104) to be turned on and off, and a scent module (200) including a module main body (201), which is disposed at the front end of the valve (106) of the bidet nozzle (100), and a scent tube (203), which is located inside the module main body (201) and sprays, by means of a spray tip (204) positioned inside the module main body (201), an essence via the scent release outlet (2013) of the module main body (201) into the ambience as a result of a force being applied on the pressure surface (2031) under said scent tube (203).

The bidet nozzle construct (A) according to the invention basically comprises a bidet nozzle (100) externally integrated on a toilet and a scent module (200) joined to the bidet nozzle (100).

The main body (101), which constitutes the basic structure of the bidet nozzle (100), is connected on the toilet under the toilet seat lid. The fixing ports (102), which protrude from the rear part of the main body (101), are formed accordingly. Said fixing ports (102) are seated on the housings on the toilet where the toilet seat lid is connected and enable the main body (101) to be fixed on the toilet. The pod channels (103), which enable the position of the main body (101) to be adjusted with respect to the housings where the toilet seat lid is connected, are present on the fixing ports (102). By means of said pod channels (103), the main body (101) is enabled to be fixed via a mounting adjustment performed on the housings where toilet seat lid is connected.

At least one water sprayer (104) extends from the bottom part of the main body (101) into the toilet bowl. Said water sprayer (104) sprays the clean water from the rear part of the toilet bowl towards the user in order to enable the user to clean off. In the front part of the water sprayer (104), a barrier (105) extends downward from the bottom of the main body (101). The barrier (105) prevents the water that emerges from the water sprayer (104) from flowing out of the toilet bowl.

A valve (106) is fixed to an end of the main body (101) in order to provide the on/off control over the water sprayer (104) and adjust the flow rate of the water flowing from the water sprayer (104). The water sprayer (104) is used by means of the valve (106), which is positioned next to the toilet bowl. A water channel, intended to provide the passage of water between the valve (106) and the water sprayer (104), is present inside the main body (101). Upon the valve (106) being opened, the flow of water is enabled from the water sprayer (104). A main body (201) is formed, which extends along the same y-axis as that of the cylindrical surface (1061) of said valve (106) and has design integrity.

Figure 2:
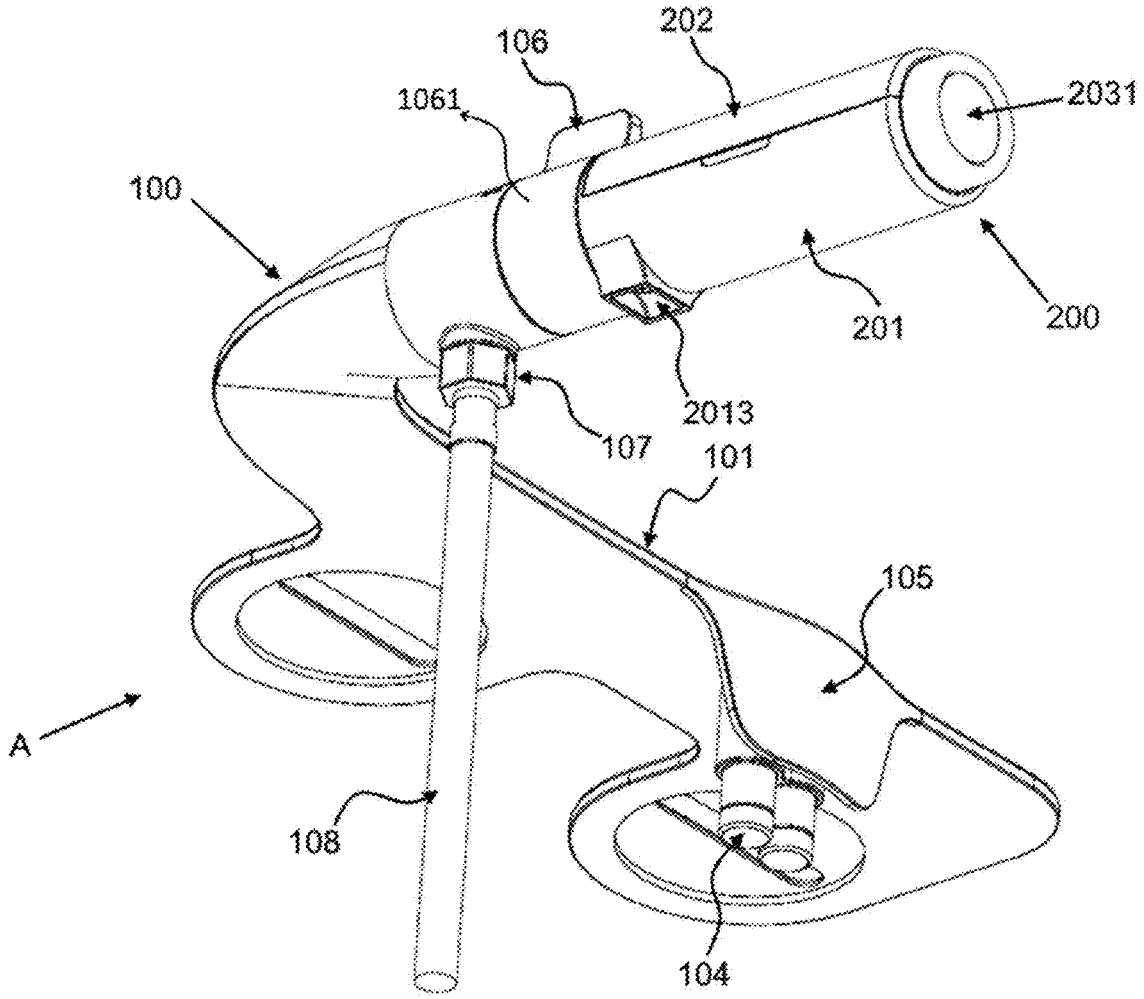
FIG. 2 is a bottom perspective view of the bidet nozzle construct according to the invention.

In order to enable the inflow of water from the flush tank inlet of the toilet to the bidet nozzle (100), a water inlet (107) is formed preferably in the lower part of the valve (106), as shown in FIG. 2, and a water inlet hose (108) is fixed to said water inlet (107). The water inlet hose (108), which is fixed at one end thereof to the water inlet (107), is connected at the other end thereof to the flush tank water inlet line of the toilet. In this way, the clean water supplied via the flush tank water inlet line of the toilet is enabled to be conveyed via the water inlet hose (108) to the valve (106) to thereby flow out of the water sprayer (104).

Figure 3:
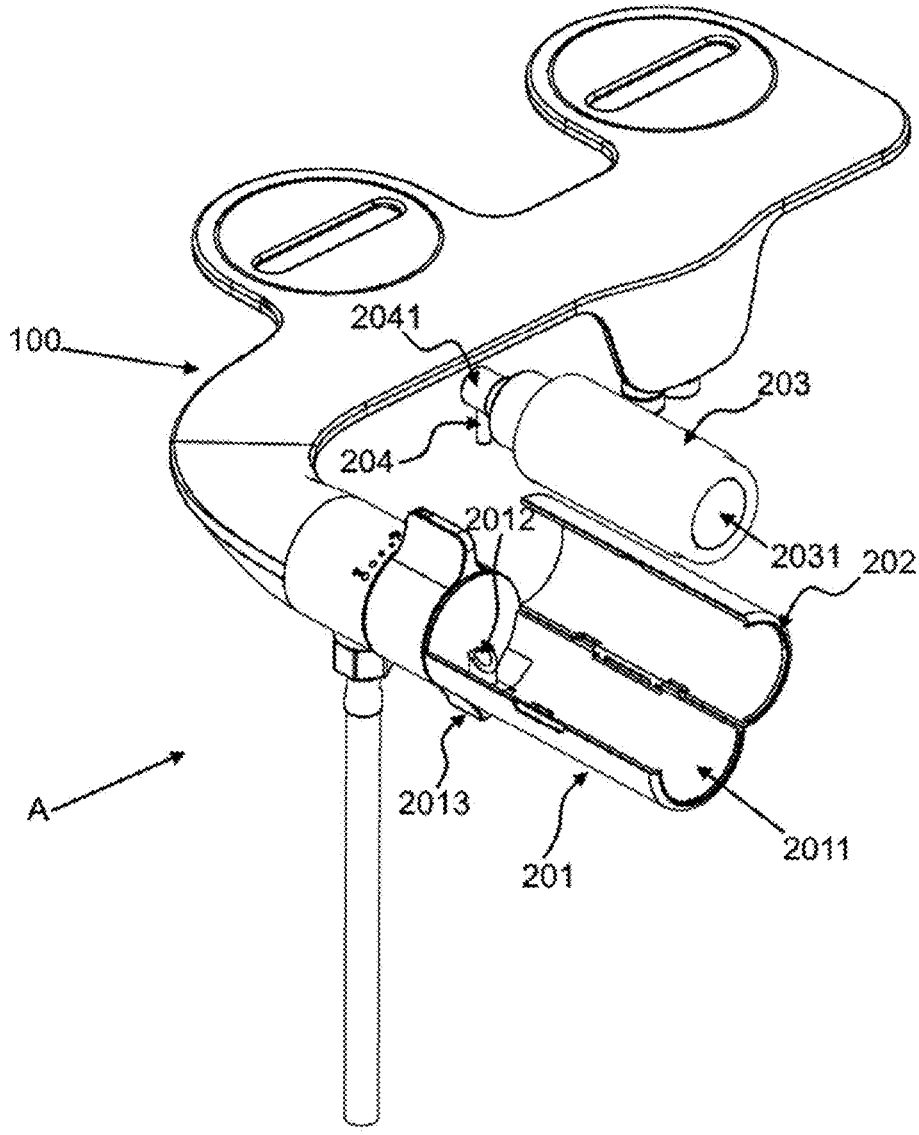
FIG. 3 is a perspective view of the scent tube of the bidet nozzle construct according to the invention in the disassembled state.

As shown in FIG. 3, a module main body (201) is fixed to the front end of the valve (106) of the bidet nozzle (100), in order to enable the elimination of the malodor developing in the ambience after the use of the toilet.

FIG. 3 illustrates a disassembly view of the bidet nozzle (100) according to the invention along with the scent module (200). The scent tube (203) has an essentially modular structure. The scent in liquid form inside the tube is enabled to be easily and quickly replaced, in case said scent is used up. The scent tube (203) is positioned on the horizontal y-axis and the design integrity is provided as shown in FIG. 1.

The module main body (201) has a tube housing (2011) preferably with a circular form. The tube housing (2011) is the part where the scent tube (203), which emits an essence into the ambience in order to scent said ambience, is positioned on the horizontal axis. The essence is stored inside the scent tube (203).

Figure 4:
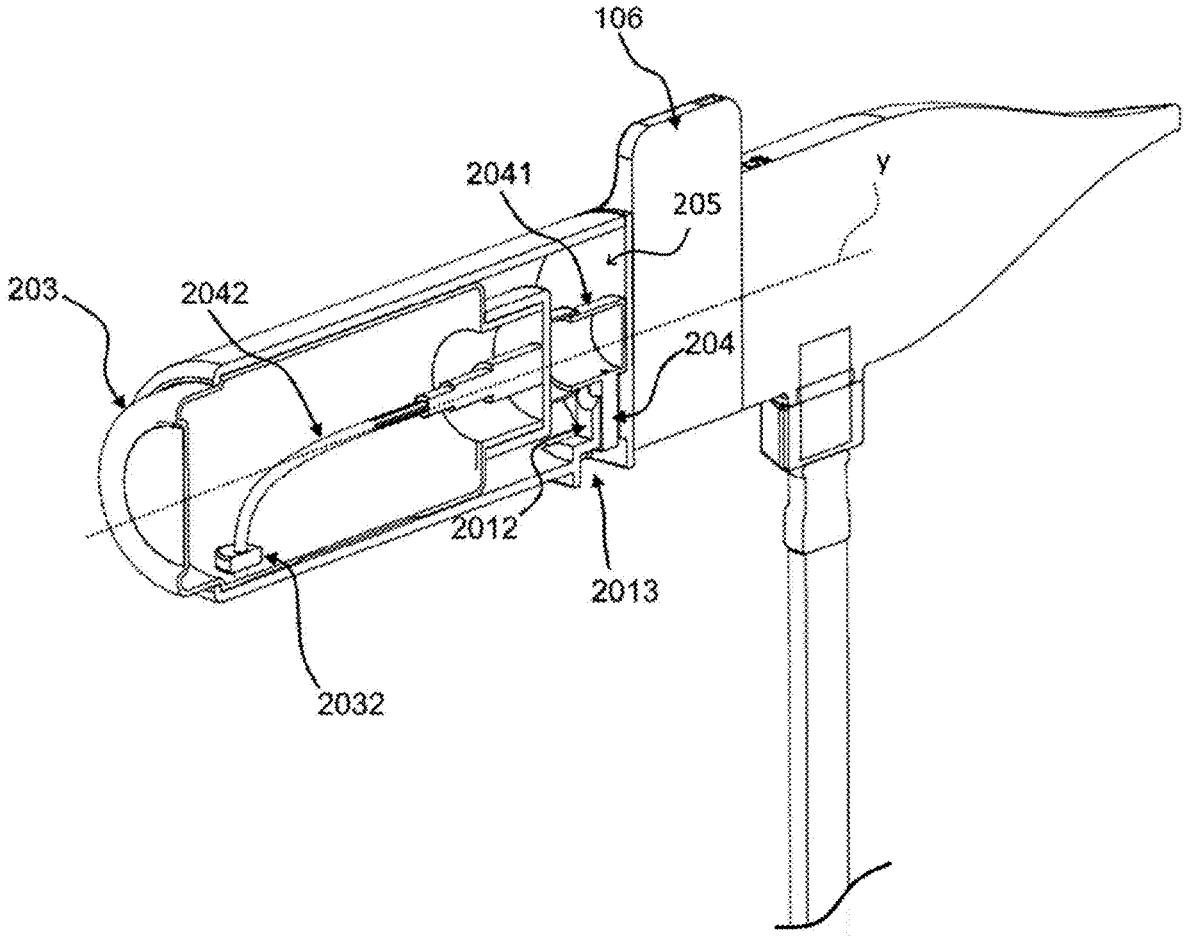
FIG. 4 is a sectional view of the scent module of the bidet nozzle construct according to the invention.

As shown in FIG. 4, a tube tip housing (2012) is present inside the tube housing (2011) and a scent release outlet (2013) is present below the tube tip housing (2012).

The tube tip housing (2012) enables the spray tip (204) on the scent tube (203) to be placed into the tube housing (2011). The scent release outlet (2013) enables the release of the essence, which is sprayed from the spray tip (204), into the ambience.

In the scent module (200), a cover (202) capable of opening and closing in a hinged manner is fixed on the module main body (201). When the essence inside the scent tube (203) is used up, it is possible to replace the scent tube (203) by opening the cover (202).

In order to enable the essence to be sprayed from the spray tip (204) of the scent tube (203), a pressure head (2041) is present on the scent tube (203) and a scent hose (2042), which is connected to the pressure head (2041) and enables the essence to be delivered to the spray tip (204), is present inside the scent tube (203). The pressure head (2041) is positioned in the tube housing (2011), on the inner side wall of the module main body (201). The scent hose (2042) forms a structure that bends towards the internal wall surface of the scent tube (203).

When a force is applied on the scent tube (203), the rear end of which protrudes from the module main body (201) when positioned into the tube housing (2011), via the pressure surface (2031) under said scent tube (203), the pressure head (2041) abuts the inner side wall of the module main body (201) and is thus triggered and enables the essence, which is drawn from the scent tube (203) via the scent hose (2042), to be sprayed from the spray tip (204). As a result, the essence sprayed from the spray tip (204) is released into the ambience via the scent release outlet (2013) to thereby provide said ambience with a pleasant scent. On the other hand, a retaining surface (205) is formed, which enables a second force to be applied on the pressure head (2041) upon the application of a force on the pressure surface (2031). A second pressure is generated owing to the presence of said retaining surface (205).

A hose retainer (2032) is present inside the scent tube (203), on the side wall of said scent tube (203). Said hose retainer (2032) enables the scent hose (2042), which enables the delivery of the essence to the spray tip (204), to extend in a curved manner inside the scent tube (203) and enables the lower end of the scent hose (2042) to be guided towards the side wall of the scent tube (203). In this way, all of the essence inside the scent tube (203), which is positioned on the horizontal axis into the tube housing (2011) of the module main body (201), is enabled to be drawn from said scent tube (203).

The operating principle of the bidet nozzle construct (A) according to the invention is as follows:

After the use of the toilet is completed, the valve (106) is opened and the user is enabled to meet the personal cleaning need upon the spraying of the clean water from the water sprayer (104) according to the desired flow rate.

In order to eliminate the malodor developing in the ambience as a result of the use of the toilet, the pressure head (2041) abuts the inner side wall of the module main body (201) and is thus triggered, upon the application of a force on the pressure surface (2031) of the scent tube (203), and the essence drawn from the scent tube (203) by means of the scent hose (2042) is enabled to be sprayed from the spray tip (204). In this way, the ambience is provided with a pleasant scent by releasing the essence, which is sprayed from the spray tip (204), into said ambience via the scent release outlet (2013).

The invention claimed is:

1. A bidet nozzle construct configured for use with a toilet, the bidet nozzle construct comprising:

a bidet nozzle having a main body, the main body configured to be affixed to a toilet;

at least one water sprayer extending from below the main body;

a valve positioned at one end of the main body, the valve configured to turn the water sprayer on and off; and a scent module comprising:

a main body, having a tube housing connected to the valve of the bidet nozzle;

a scent release outlet, disposed inside the tube housing;

a scent tube having an essence stored therein the scent tube positioned in the tube housing, the scent tube having a pressure surface thereon; and a spray tip provided on the scent tube, the spray tip configured to spray the essence through the scent release outlet when a user presses on the pressure surface of the scent tube.

2. The bidet nozzle construct of claim 1, the scent module comprising a cover.

3. The bidet nozzle construct of claim 1, wherein the tube housing of the main body of the scent module has a tube tip housing therein, the spray tip of the scent tube positioned in the tube tip housing.

4. The bidet nozzle construct of claim 3, wherein the scent release outlet is located under the tube tip housing.

5. The bidet nozzle construct of claim 1, further comprising a pressure head located on said scent tube and positioned on an inner side wall of the main body of the scent module in the tube housing.

6. The bidet nozzle construct of claim 5, wherein the bidet nozzle construct comprises a scent hose connected to the pressure head inside said scent tube.

7. The bidet nozzle construct of claim 6, wherein scent hose forms a structure bending towards the inner wall surface of said scent tube.

8. The bidet nozzle construct of claim 6, wherein a hose retainer is positioned inside said scent tube, on a side surface thereof, one end of the scent hose being affixed to the hose retainer.

* * * * *